United States Patent [19]

Arnold

[11] Patent Number: 4,570,921

[45] Date of Patent: Feb. 18, 1986

[54] CALIBRATED TUBULAR ELASTIC EXERCISING DEVICE

[76] Inventor: Frank Arnold, 6555 2nd Ave. SW, Naples, Fla. 33999

[21] Appl. No.: 563,093

[22] Filed: Dec. 19, 1983

[51] Int. Cl.[4] ..... A63B 21/02

[52] U.S. Cl. ..... 272/137; 272/142

[58] Field of Search ..... 272/137, 138, 142, 135, 272/DIG. 5, 93; 434/252; 273/35 R, 26 D, 85 R; 128/327, 774

[56] References Cited

U.S. PATENT DOCUMENTS

| | | | |
|---|---|---|---|
| 1,638,003 | 8/1927 | Neumann | 272/137 |
| 1,810,255 | 6/1931 | Poulos | 272/137 |
| 1,945,134 | 1/1934 | Brunk | 272/137 |
| 1,998,226 | 4/1935 | Draheim | 272/137 |
| 3,589,721 | 6/1971 | Cronauer | 272/137 |
| 3,807,730 | 4/1974 | Dalton et al. | 272/142 X |
| 3,819,177 | 6/1974 | Spiro | 272/125 X |
| 4,019,734 | 4/1977 | Lee et al. | 272/137 |
| 4,026,549 | 5/1977 | Gunn | 272/137 |
| 4,040,620 | 8/1977 | Friedman | 272/142 X |
| 4,193,593 | 3/1980 | Wilson | 272/137 |

FOREIGN PATENT DOCUMENTS

| | | | |
|---|---|---|---|
| 833418 | 2/1970 | Canada | 272/142 |

OTHER PUBLICATIONS

Black Master—Black Belt Magazine, May 1980, p. 47.

*Primary Examiner*—Richard J. Apley
*Assistant Examiner*—William R. Browne
*Attorney, Agent, or Firm*—Merrill N. Johnson

[57] ABSTRACT

For use in a program of physical exercise, a hollow cylindrical tube made of rubber, which tube is calibrated along its outer surface with an 0 permanently imprinted at the midpoint between the ends of the tube and the numerals 1, 2, 3 and 4 imprinted along the outer surface of the tube at spaced intervals from the midpoint of the tube. The tube is approximately 75 inches in length and has an outer diameter of $\frac{7}{8}$ths of an inch and an inner diameter of $\frac{3}{4}$ths of an inch.

2 Claims, 3 Drawing Figures

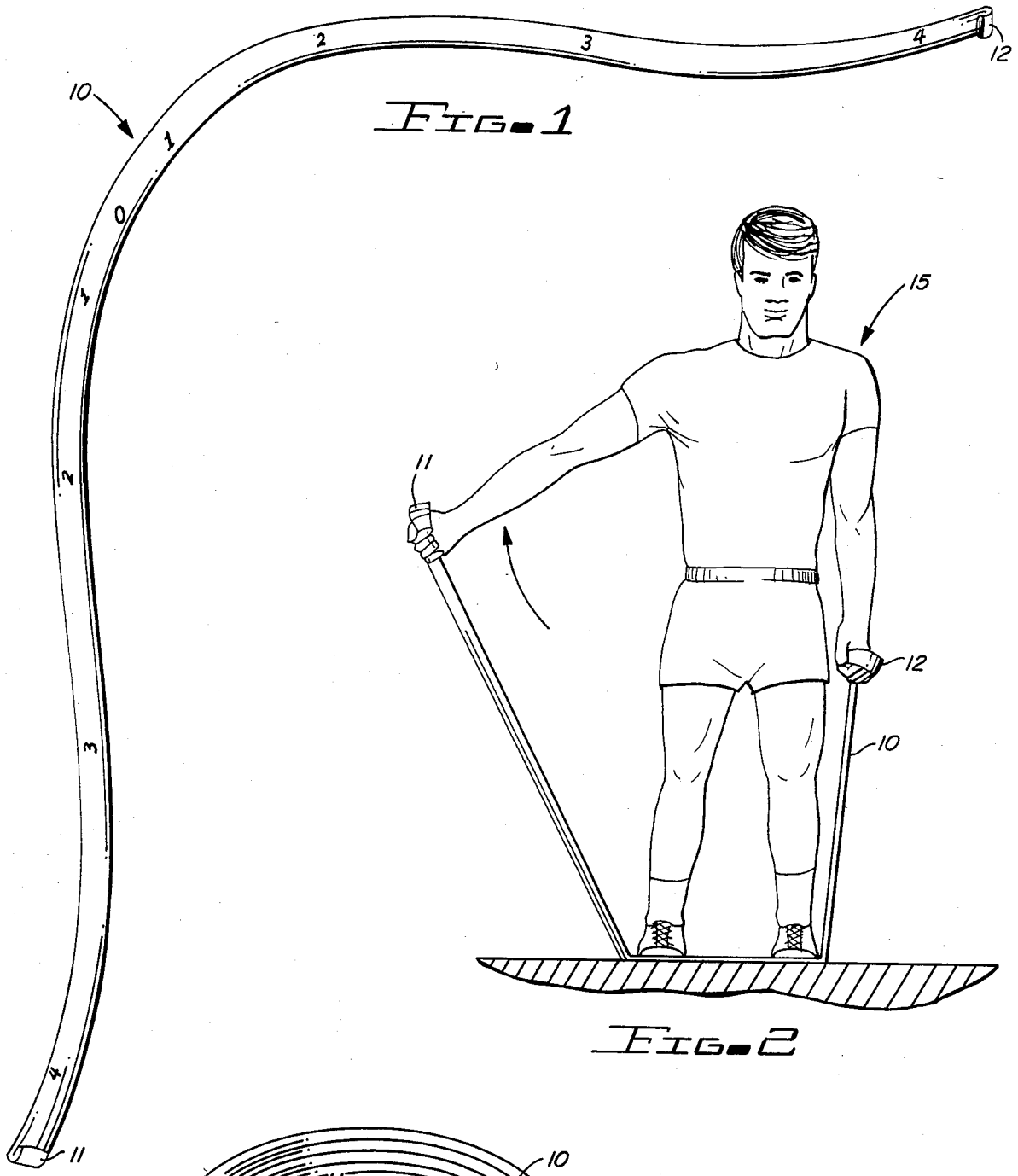
FIG. 1
FIG. 2
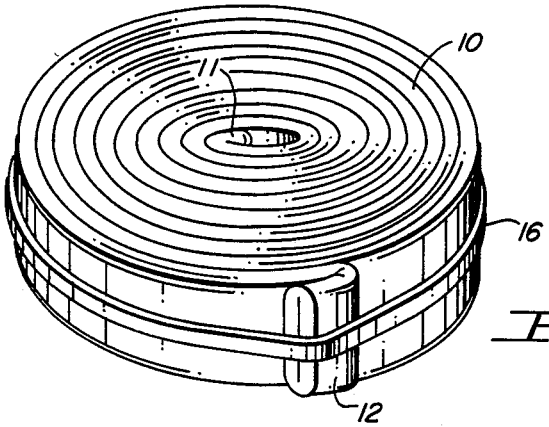
FIG. 3

CALIBRATED TUBULAR ELASTIC EXERCISING DEVICE

BACKGROUND AND SUMMARY OF THE INVENTION

Physical exercise to promote and maintain body fitness has been practiced by the human race since the dawn of civilization. Over the years numerous machines have been developed to assist persons desiring to improve their physical condition—bar bells, rowing machines, treadmills and slantboards, to mention a few.

The growing popularity of physical fitness programs has accelerated the demand for devices to be used in body building exercises. But the high price of most exercise machines has discouraged many people from buying an exercise machine.

Sensing the unfulfilled demand for a device for use in a physical exercise program which is simple, effective, safe and inexpensive, I have invented a device which supplies the resistance levels necessary to develop simply, effectively, safely and inexpensively all the muscle groups of the human body.

Used faithfully in accordance with my directions in a program of daily exercise, my device which I have named the E-Z ExerciZer TM will develop and improve the tone of all the muscle groups. Moreover, my device is so compact and weightless that it can be included in any person's personal luggage so that the user can continue his or her exercise program during business travel and vacations.

Finally, since my E-Z ExerciZer is made of pure natural rubber, it is virtually foolproof and despite vigorous use will last many years.

Briefly, my E-Z ExerciZer is a hollow cylindrical tube of pure natural rubber or latex approximately 75 inches in length having an elasticity of up to 750% and a tensile strength of 3,500 pounds per square inch. The exercise tool preferably has an outside diameter of $\frac{7}{8}$ths of an inch and an inside diameter of $\frac{3}{4}$ths of an inch, and is calibrated along its outer surface to allow its user to select the desired intensity of resistance for the particular exercise to be performed.

In use, the device is grasped in both hands, positioning each hand at identical numbers appearing at equal distances from the "O" imprinted at the middle of the tubular device. For each exercise, the user by experimentation will determine the proper amount of resistance desired. The shorter the length of the E-Z ExerciZer between the hands, the greater the resistance of the device to free flexing of the muscles. After a few days' use of the E-Z ExerciZer in accordance with my instructions, the user will find he or she will shorten the distance between the hands grasping the device due to an increase in strength resulting from the exercise program.

BRIEF DESCRIPTION OF THE DRAWINGS

FIG. 1 is a perspective view of my E-Z ExerciZer showing the calibrations on its outer surface.

FIG. 2 shows the exercise device being used by a person engaged in one of the exercises of my exercise program.

FIG. 3 shows the E-Z ExerciZer rolled up and secured by a rubber band ready for storage or travel.

DETAILED DESCRIPTION OF THE INVENTION

Referring to FIG. 1 of the drawings exercise device 10, which I have named the E-Z ExerciZer, is shown uncoiled and ready for use. Device 10 is a flexible hollow cylindrical tube made of pure natural rubber or latex. Preferably the device is 75 inches in length and its outer diameter $\frac{7}{8}$ths of an inch and its inner diameter $\frac{3}{4}$ths of an inch.

Being made of latex, the tube can be stretched up to 750% of its normal length without breaking and has a tensile strength of 3,500 pounds per square inch.

At each extremity of the device, the end is folded back upon itself about $\frac{7}{8}$ths of an inch to form beads 11 and 12 at the opposite ends.

The exercise device 10 is specially calibrated to locate its center and to permit the user to choose the intensity of resistance desired for each exercise throughout the complete exercise program.

The exact middle of the device is calibrated with the numeral "0" as best shown in FIG. 1. All exercises require the location of the middle of the device, and this is facilitated by the numeral "0" clearly imprinted at the middle of the E-Z ExerciZer. At a distance of 10 inches on both sides of the 0, the numeral "1" has been imprinted onto the outer surface of the tube. Likewise at a distance of $14\frac{1}{2}$ inches on both sides of the 0, the numeral "2" has been imprinted, and at a distance of $25\frac{1}{2}$ inches on both ends of the tube the numeral "3" has been imprinted, and at a distance of $34\frac{1}{2}$ inches the numeral "4" has been imprinted. The following table indicates the resistance in pounds required to stretch the E-Z ExerciZer 25 inches:

| E-Z ExerciZer Calibration | Resistance in Pounds per 25-inch Stretch |
|---|---|
| "4" | 20 |
| "3" | 30 |
| "2" | 40 |
| "1" | 50 |

FIG. 2 shows exercise device 10 being used in one of my recommended exercises. Individual 15 locates the middle of device 10 beneath his or her feet by reference to the 0 imprinted at the middle of the device. Individual 15 then stands erect and, with arms down along his sides, grasps the device firmly in both hands without stretching the E-Z ExerciZer.

The individual then raises his right arm away from the body as shown in FIG. 2 up to shoulder height and then lowers the right arm slowly down alongside the body. This exercise repeated 10 times and then repeated 10 times using the left arm will flex and provide muscle tone to the following muscles: biceps, brachioradialia, extensors, flexors, palmaris longus, triceps, deltoids, latissimus dorsi, pectoralis major, sternocleidomastoid, and trapezius.

The instruction book included with my E-Z ExerciZer contains detailed directions for fifty different exercises which will develop all the muscle groups. However, the fifty exercises will not be described here since the exercises as such do not form a part of my exercise device.

FIG. 3 shows my E-Z ExerciZer 10 rolled up and secured by a rubber band 16. Rolled up and secured by a rubber band as shown in FIG. 3, the exercise tool forms a compact disk having a diameter of less than five inches and just over an inch thick and weighing less than one-half pound. Thus the E-Z ExerciZer can easily be included in an individual's personal travel luggage. And thus an individual can take the device along on business travel or vacations to continue his exercise program without interruption.

While I have shown and described a preferred form of my exercise device, minor variations in configuration and calibration will be apparent to those skilled in the art of physical exercise. Accordingly, my invention shall not be limited by the foregoing description and drawings, and the scope and spirit of my invention is limited only by the following claims.

I claim:

1. An exercise device consisting of an elongated hollow tube made entirely of pure rubber, said tube having a length of approximately 75 inches, an outer diameter of $\frac{7}{8}$ths of an inch, and an inner diameter of $\frac{3}{4}$ths of an inch, and said tube being calibrated by the following numerals being permanently imprinted on the outer surface of the device:

0 imprinted at the midpoint between the ends of the device;

1 imprinted 10 inches from the 0 measured toward each end;

2 imprinted $14\frac{1}{2}$ inches from the 0 measured toward each end;

3 imprinted $25\frac{1}{2}$ inches from the 0 measured toward each end; and 4 imprinted $34\frac{1}{2}$ inches from the 0 measured toward each end.

2. An exercise device as set forth in claim 1 in which each end of the device is folded back upon itself approximately $\frac{3}{8}$ths of an inch to provide a circular bead at each end of the device.

* * * * *